US005313135A

United States Patent [19]

Fletcher

[11] Patent Number: 5,313,135

[45] Date of Patent: May 17, 1994

[54] HEADLAMP CAPSULE

[75] Inventor: William S. Fletcher, Westmoreland, N.H.

[73] Assignee: Osram Sylvania Inc., Danvers, Mass.

[21] Appl. No.: 816,163

[22] Filed: Jan. 2, 1992

[51] Int. Cl.[5] ..... H01J 05/60

[52] U.S. Cl. ..... 313/318; 313/578; 313/51; 362/226

[58] Field of Search ..... 313/318, 51, 578, 579, 313/315; 439/602, 603, 611, 734; 362/226, 296, 308

[56] References Cited

U.S. PATENT DOCUMENTS

| | | | |
|---|---|---|---|
| 4,492,893 | 1/1985 | Steiner et al. | 313/318 |
| 4,547,838 | 10/1985 | Wakimizu | 313/318 X |
| 5,029,057 | 7/1991 | Devir et al. | 313/318 X |
| 5,229,683 | 7/1983 | Eckhardt et al. | 313/318 |

FOREIGN PATENT DOCUMENTS

| | | | |
|---|---|---|---|
| 3047210 | 7/1982 | Fed. Rep. of Germany | 313/318 |

*Primary Examiner*—Donald J. Yusko
*Assistant Examiner*—Ashok Patel
*Attorney, Agent, or Firm*—William E. Meyer

[57] ABSTRACT

A headlamp capsule having lamp capsule, base, web and connectors, is disclosed. The web comprises an inner support, an outer support, and a plurality of cross linkages that may be adjusted. The lamp capsule is held by the base, and the base is in turn held by the adjustable web. Adjusting the web after the lamp capsule has be positioned in the base, allows for corrective repositioning of the light source. The small number of parts, and the simplicity of each part makes the total structure very inexpensive, and still yields an accurately adjustable headlamp capsule.

10 Claims, 4 Drawing Sheets

HEADLAMP CAPSULE

1. Technical Field

The invention relates to lamps and particularly to electric lamps. More particularly the invention is concerned with a support structure for an electric lamp.

2. Background Art

Vehicle headlamps have required projected light patterns that are achieved through optical designs of the reflectors and lenses. Underlying the optical design is the requirement that the light source be located in an expected position. If the light source is displaced, even a quarter millimeter, the beam at a hundred meters can be off by a meter or more. Accurately locating the headlamp filament is then necessary for headlamp quality. There is then a need for a means of finely adjusting the headlamp filament position. It is equally important to keep the cost of the headlamp capsule low, and maintain durability. There is the a need for an inexpensive, durable means for finely adjusting the headlamp filament position.

DISCLOSURE OF THE INVENTION

A headlamp capsule may be formed with a lamp capsule having an envelope, a light source enclosed in the envelope, at least two leads for powering the light source extending through an envelope seal for connection. The lamp capsule is coupled by a first base coupling means to a base. A second base coupling means couples the base to a first side of a mechanically adjustable web. The second side of the web couples to means for mounting the headlamp capsule. Means for supporting electrical connectors are formed in the base, and at least two electrical connectors are held in place by the base, and electrically connected to the lamp capsule leads.

BEST MODE FOR CARRYING OUT THE INVENTION

Figure 1:
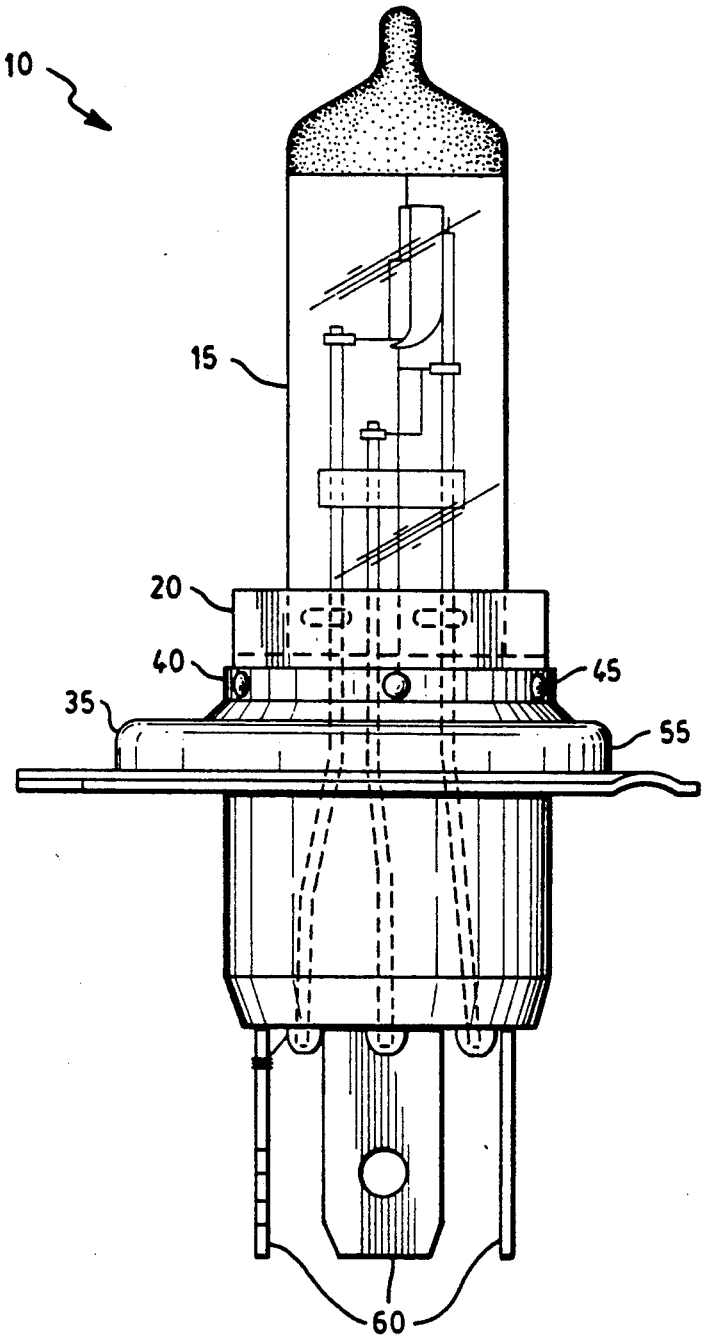
FIG. 1 shows an elevational view of a preferred embodiment of a headlamp capsule.

FIG. 1 shows a preferred embodiment of a headlamp capsule 10. The headlamp capsule 10 may be assembled from a lamp capsule 15, a base 20 and an adjustable web 35.

Figure 2:
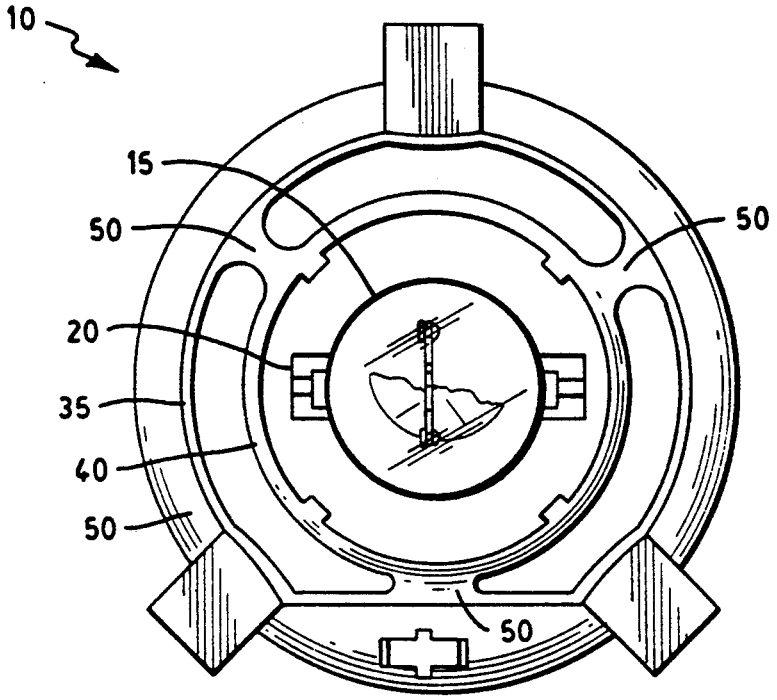
FIG. 2 shows a top view of a headlamp capsule.
Figure 3:
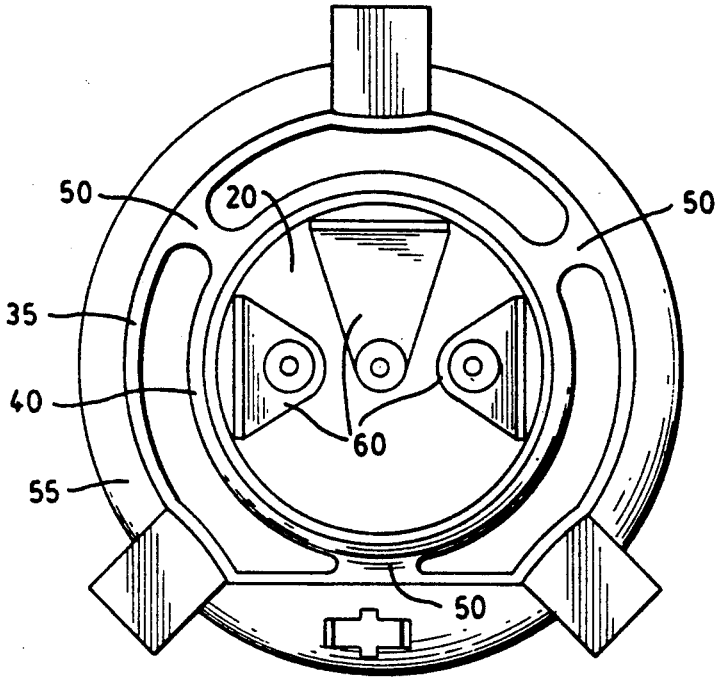
FIG. 3 shows a bottom view of a headlamp capsule.

The lamp capsule 15 has an envelope, a light source, a seal and at least two leads. The envelope is formed from a light transmissive material, such as glass or quartz, and has a tubular, or bulbous shape enclosing an internal volume. Positioned in the internal volume is a light source. The light source may be an arc discharge, or other electrically powered light source. The preferred light source is a coiled tungsten filament enclosed with a halogen environment. Along one end of the preferred lamp capsule 20 is a seal that may have any convenient form. Lamp capsules are commonly sealed by heating an end of the quartz tube to a plastic state, and then pressing the plastic quartz between two press heads. The press heads may include a variety of formed features to enhance the seal, or to enhance the coupling or alignment of the lamp capsule 15 in a support device. The preferred lamp capsule 15 is a press seal with two side by side bumps on each side of the press seal area. By way of example lamp capsule 15 is shown as a tubular, double filamented headlamp capsule 10 having three leads. FIGS. 2, and 3 show a top, and bottom view of a lamp capsule 15.

Figure 4:
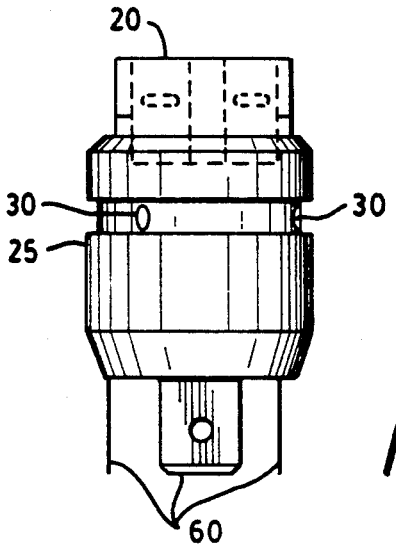
FIG. 4 shows an front elevational view of a base.
Figure 5:
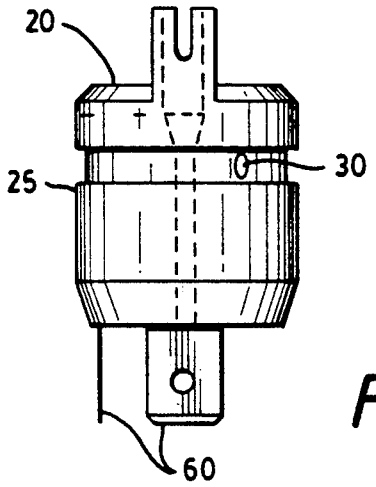
FIG. 5 shows a side elevational view of a base.
Figure 6:
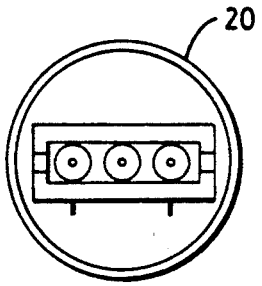
FIG. 6 a top view of a base.
Figure 7:
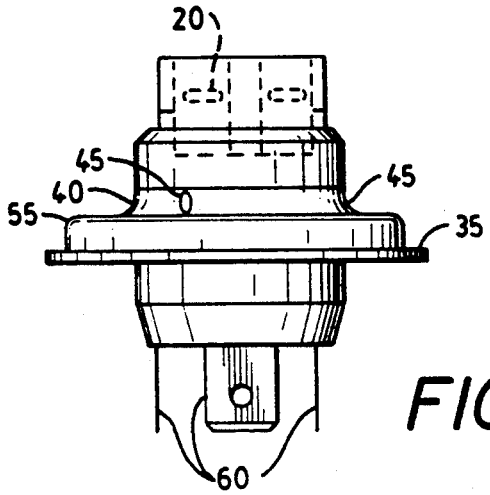
FIG. 7 shows an front elevational view of a base and web.
Figure 8:
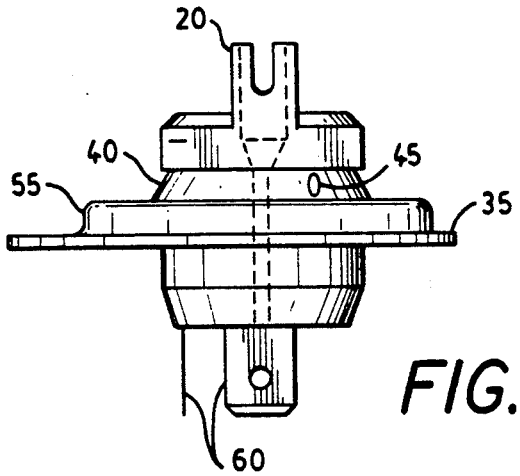
FIG. 8 side elevational view of a base and web.
Figure 9:
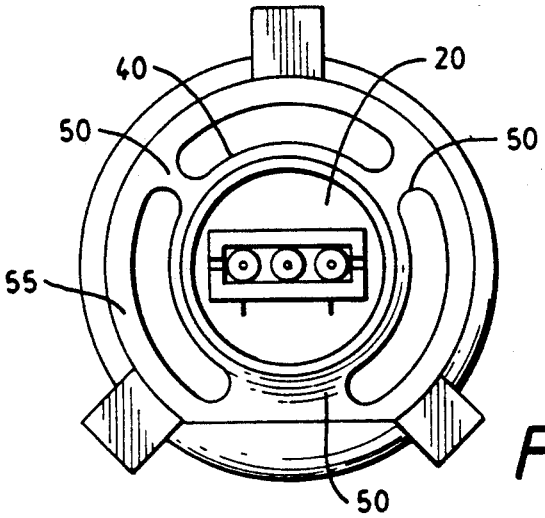
FIG. 9 s a bottom view of a base and web.

FIG. 4, 5 and 6 show front, side and top views of a base. The preferred base 20 is single piece molded from a glass filled thermoplastic such as Amodel 45. The base 20 includes a first base coupling means for retaining or coupling to the lamp capsule 15. The coupling mechanism between the lamp capsule 15 and the base 20 is not felt to be crucial, and numerous methods for making the first base coupling respect to the are known. In the preferred embodiment, the base 20 has a generally cylindrical structure, with one end formed with two opposed arms defining a cavity therebetween to receive, and couple with a portion of the press seal of the lamp capsule 15. The plastic arms are slightly flexible and may be spread a small amount to clip to the press seal and thereby hold the lamp capsule 15. Features formed along the press seal may then conformally couple with corresponding features formed on the base 20's internal wall to thereby enhance coupling and retention of the lamp capsule 15 by the base 20. In the preferred embodiment, the opposed arms each include side by side dimples formed in the interior wall to mate with the side by side bumps formed on each side of the press seal.

The base 20 also includes a second base coupling means to couple the base 20 to the web 35. In the preferred embodiment, formed approximately midway along an exterior of the base 20 is a means for coupling the base 20 to the web 35, such as a circumferential side notch 25. In the side notch 25 may be one or more indentations 30. The side notch 25 then roughly locates the base 20 vertically with respect to the web 35, while indentations 30 roughly locate the base 20 rotationally with respect to the web 35.

The lamp capsule 10 also includes a web 35. The inclusion of the adjustable web 35 allows accurate, corrective repositioning of the light source with respect to the lamp capsule 15 mounting. To mate with the base 20, the web 35 has a first coupling side, such as an inner support ring 40. The web 35 also includes a second coupling side, such as a metal ring, for coupling to a reflector housing or similar support structure. Intermediate the first coupling side and the second coupling side are two or more adjustable cross linkages 50. The lamp capsule 15 may be correctively repositioned while being held by the web 35 by reshaping the adjustable cross linkages 50. The preferred web 35 is a single, stamped metal piece with an inner support ring 40 joined to a series of metal cross linkages 50 that in turn couple to an outer support ring 55.

The preferred web 35 has an inner support ring 40, two or more malleable cross linkages 50, and an outer support ring 55. The inner support ring 40 may be a metal ring with a width and diameter sufficient to fit snuggly in or against the side notch 25. The inner support ring 40 may further include a number of bendable tabs or dimples 45 formed along the inside edge of the inner support ring 40 to fit snuggly with corresponding indentations 30 formed in the side notch 25. In one embodiment, four indentations 30 were formed in the side notch 25, that paired with four corresponding dimples 45 formed along the inner support ring 40. The base 20 indentations 30 may be aligned with and coupled to the dimples 45 formed on the preferred inner support ring 40.

Positioned along web 35 are two or more malleable cross linkages 50. The cross linkages 50 are preferrably positioned equal angularly around the inner support ring 40, and extend radially outward. The preferred cross linkages 50 comprise three flat, malleable metal cross linkages 50 angularly spaced around the lamp axis at about one hundred and twenty degrees one from the other. The three metal cross linkages 50, with sufficient force, are malleable, so the inner support ring 40 may be raised, lowered or angled with respect to the outer support ring 55. The metal cross linkages 50 are nonetheless sufficiently stiff that once the lamp capsule 15 is aligned by adjusting the cross linkages 50, the reshaped cross linkages 50 hold the lamp capsule 15 firmly. The cross linkages 50 may also include rippled, or accordion like features to provide a greater range of adjustment, and may include only two, three, or more than three cross linkages 50. The cross linkages 50 also couple to an outer support ring 55.

The preferred outer support ring 55 is also a metal ring. The outer support ring 55 may include positioning keys, or locking features for mounting the lamp capsule to a support structure. The preferred means for coupling to a support structure, such as a headlamp reflector housing, is an H4 type headlamp coupling as typically used in European style headlamps. By way of example, web 35 is shown as a inner support ring 40 supported by three flat cross linkages 50 coupled to an outer support ring 55. The lamp capsule 15, is then held by the base 20, and the base 20 is held by web 35. The lamp capsule 15's position may then be adjusted by adjusting the web 35.

The preferred lamp capsule 15 is electrically connected through the leads to the lug connectors 60. By way of example, the lug connectors 60 are shown as a flat, brass blade type lug connectors 60, having a right angle shape. One leg of each right angle lug connector 60 is staked to the base with a lamp lead soldered or welded to the lug. The other leg of each right angle lug projects away from the base 20 providing a plug type connector. Other lug connector 60 forms may be used.

The accurately adjustable headlamp capsule 10 may be assembled by forming a lamp capsule 15, providing a base 20 with an adjustable web 35, positioning the lamp capsule 15 in the base 20, supported by the web 35, and adjusting the web 35 to accurately position the light source. Electrical connections for the lamp leads are then completed.

The first step is to form a lamp capsule 15 with a designed coupling region. A base 20 is molded and lug connectors 60 are staked to the base 20. The base 20 is then coupled to an adjustable web 35. The base 20 may be positioned in the web 35 by snapping the base 20 into the inner support ring 40, rotating the base 20 to align the base 20's indentations 30 with the inner support ring 40's tabs or dimples 45, and then, if necessary, bending the tabs of the inner support ring 40 into the indentations 30. The lamp capsule 15 leads are then threaded through formed passages of the base, and through the eyelets of the lug connectors 60. The lamp capsule 15 is then clipped into the receiving cavity formed in the base 20. The lamp capsule 15 is then held by the base 20 and the base 20 is held by the web 35. The lamp capsule 15, base 20 and web 35 assembly is then examined for proper location of the light source with respect to the web 35's outer support ring 55. If the light source is not properly located, the web 35's cross linkages 50 may be bent, twisted or turned, to allow the lamp capsule 15 to be shifted with respect to outer support ring 70 thereby relocating the light source closer to, if not exactly into proper position.

The preferred alignment method is to locate the lamp capsule 15, base 20 and web 35 assembly in a computer driven vision sensor, where the light source position is detected and compared with a reference. If the light source is not in proper position, mechanical arms are brought into contact with the cross linkages 50. The arms may then press on the cross linkages 50, causing the light source to approach or come into exact alignment with respect to the reference. The arms are then withdrawn, leaving the reshaped web 35 adjusted to retain the lamp capsule 15 in proper position.

The lamp leads are then coupled to the adjacent lug connectors 60. The form of coupling depends in part on the preferred form of the electrical connectors 60. The Applicant prefers flat brass lug connectors with formed eyelets staked to the bottom of the base 20. Round molybdenum leads wires, are threaded through the base 20 and lug connector eyelets, and soldered to the lug connectors. The lead to lug connection is performed after to the light source alignment, so the final corrective positioning does not tension the lead and crack the envelope.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A headlamp capsule comprising:

a) a lamp capsule having an envelope, a light source enclosed in the envelope, at least two leads for powering the light source extending through an envelope seal for the leads, b) a base, including a first coupling means for coupling the base to the lamp capsule, and a second coupling means for coupling the base to the web, c) web having a first support side coupled to the second coupling means of the base, a second support side for coupling the web to a headlamp capsule support, and at least two adjustable cross linkages coupled intermediate the first support side and the second support side, and d) at least two electrical connectors held in place by the base, and electrically connected to the lamp capsule leads.

2. The apparatus in claim 1, wherein the first means for coupling the base to the lamp capsule is a formed interior wall.

3. The apparatus in claim 1, wherein the second coupling means is a formed exterior wall of the base.

4. The apparatus in claim 1, wherein the lamp capsule is a tungsten halogen lamp.

5. The apparatus in claim 1, wherein the light source is a coiled filament.

6. The apparatus in claim 1, wherein the seal is a press seal that seals the at least two electrical leads.

7. The apparatus in claim 1, wherein the base includes a wall defining a cavity to receive and couple to the lamp capsule.

8. A headlamp capsule comprising:

a) a lamp capsule having an envelope, a light source, a seal and at least two leads, b) a base supporting the lamp capsule, and an adjustable web, wherein i) the base includes means for coupling the base to the lamp capsule and means for coupling the base to the web, and ii) the web includes an inner support coupled to the base, an outer support having a coupling means for mating with a headlamp capsule receptacle, and at least two malleable cross linkages coupling the inner support to the outer support, and c) at least two electrical connectors held in place by the base, and electrically connected to the lamp capsule leads.

9. The apparatus in claim 8, wherein the inner support is a ring.

10. The apparatus in claim 8, wherein the outer support is a ring.

* * * * *